US009356374B2

(12) United States Patent
Hoyack et al.

(10) Patent No.: US 9,356,374 B2
(45) Date of Patent: May 31, 2016

(54) FLOAT ADAPTER FOR ELECTRICAL CONNECTOR

(71) Applicant: Amphenol Corporation, Wallingford, CT (US)

(72) Inventors: Michael Andrew Hoyack, Sandy Hook, CT (US); Owen Robert Barthelmes, Putnam Valley, NY (US)

(73) Assignee: Amphenol Corporation, Wallingford, CT (US)

( * ) Notice: Subject to any disclaimer, the term of this patent is extended or adjusted under 35 U.S.C. 154(b) by 0 days.

(21) Appl. No.: 14/594,585

(22) Filed: Jan. 12, 2015

(65) Prior Publication Data

US 2015/0126054 A1 May 7, 2015

Related U.S. Application Data

(63) Continuation-in-part of application No. 13/737,375, filed on Jan. 9, 2013, now Pat. No. 9,039,433.

(51) Int. Cl.

| | |
|---|---|
| ***H01R 12/91*** | (2011.01) |
| ***H01R 24/54*** | (2011.01) |
| *H01R 103/00* | (2006.01) |
| *H01R 12/73* | (2011.01) |

(52) U.S. Cl.

CPC ..... *H01R 12/91* (2013.01); *H01R 24/542* (2013.01); *H01R 12/737* (2013.01); *H01R 2103/00* (2013.01); *Y10T 29/49208* (2015.01)

(58) Field of Classification Search

CPC ..... H01R 12/91
USPC ..... 439/246–248, 252, 382, 383, 385, 2
See application file for complete search history.

(56) References Cited

U.S. PATENT DOCUMENTS

| | | | | |
|---|---|---|---|---|
| 2,603,681 | A | 7/1952 | Salisbury | |
| 2,999,998 | A | 9/1961 | Cole | |
| 3,713,075 | A * | 1/1973 | Clark | H01R 13/18 174/99 E |
| 4,227,765 | A | 10/1980 | Neumann et al. | |
| 4,466,048 | A | 8/1984 | Schwab | |
| 4,541,032 | A | 9/1985 | Schwab | |
| 4,674,809 | A | 6/1987 | Hollyday et al. | |
| 4,726,787 | A | 2/1988 | Stine | |
| 4,728,301 | A | 3/1988 | Hemmer et al. | |
| 4,789,351 | A | 12/1988 | Fisher, Jr. et al. | |
| 4,846,731 | A | 7/1989 | Alwine | |

(Continued)

FOREIGN PATENT DOCUMENTS

DE 202012000487 U1 2/2012

*Primary Examiner* — Ross Gushi
(74) *Attorney, Agent, or Firm* — Blank Rome LLP

(57) ABSTRACT

A float adapter for an electrical connector that includes a conductive shell and an insulator received in the conductive shell. The insulator includes an engagement end, an interface end that is opposite the engagement end, and a reduced diameter middle portion therebetween. The insulator includes an inner bore that extends through the engagement end, the interface end, and the reduced diameter middle portion. The interface end has a lead-in tip portion that extends outside of the first end of the conductive shell. The lead-in tip portion has a tapered outer surface that terminates in an end face surface and a shoulder remote from the end face surface that defines an outer diameter that is larger than the inner diameter of the conductive shell. An inner contact is received in the inner bore of the insulator. The inner contact has socket openings at either end.

16 Claims, 15 Drawing Sheets

(56) References Cited

U.S. PATENT DOCUMENTS 4,857,014 A 8/1989 Alf et al.
4,925,403 A 5/1990 Zorzy
5,062,808 A 11/1991 Hosler, Sr.
5,137,462 A 8/1992 Casey et al.
5,217,391 A 6/1993 Fisher, Jr.
5,257,161 A 10/1993 Ocerin et al.
5,329,262 A 7/1994 Fisher, Jr.
5,548,088 A 8/1996 Gray et al.
5,647,749 A 7/1997 Atoh et al.
5,700,160 A 12/1997 Lee
5,879,177 A 3/1999 Honma
5,980,290 A 11/1999 Meynier et al.
6,059,577 A 5/2000 Eriksson
6,079,986 A 6/2000 Beshears
6,166,615 A 12/2000 Winslow et al.
6,174,206 B1 1/2001 Yentile et al.
6,224,421 B1 5/2001 Maturo, Jr.
6,497,579 B1 * 12/2002 Garbini ..... H01R 13/6315 439/246
6,663,434 B1 12/2003 Wu
6,695,622 B2 2/2004 Korsunsky et al.
6,773,285 B2 8/2004 Bernat et al.
6,773,286 B1 8/2004 Wu
6,814,630 B1 11/2004 Tomasino
6,827,608 B2 12/2004 Hall et al.
6,835,079 B2 12/2004 Gentry et al.
6,908,325 B2 * 6/2005 Bernat ..... H01R 13/6315 439/246
6,976,862 B1 12/2005 Ormazabal Ocerin
7,112,078 B2 9/2006 Czikora
7,210,941 B2 5/2007 Rosenberger
7,229,303 B2 6/2007 Vermoesen et al.
7,306,484 B1 12/2007 Mahoney et al.
7,442,080 B1 10/2008 Tsen
7,445,458 B1 11/2008 Yamane
7,445,467 B1 11/2008 Matsuo
7,478,475 B2 1/2009 Hall
7,563,133 B2 7/2009 Stein
7,645,151 B2 1/2010 Moll et al.
7,717,716 B2 5/2010 Dahms
7,731,528 B2 6/2010 Feldman et al.
7,762,854 B1 7/2010 Peng
7,896,655 B1 3/2011 Blasick et al.
8,323,058 B2 12/2012 Flaherty et al.
8,360,789 B2 1/2013 Yin et al.
8,568,163 B2 10/2013 Burris et al.
8,573,983 B2 11/2013 Zieder
8,597,050 B2 12/2013 Flaherty et al.
8,734,167 B2 5/2014 Aimoto
8,801,459 B2 8/2014 Mrowka
9,039,433 B2 * 5/2015 Barthelmes ..... H01R 13/629 439/248
9,160,122 B2 * 10/2015 Sato ..... H01R 12/91
2002/0061670 A1 5/2002 Havener et al.
2002/0111057 A1 8/2002 Bernat et al.
2002/0142625 A1 10/2002 Berghorn et al.
2004/0014334 A1 1/2004 Lu
2004/0038586 A1 2/2004 Hall et al.
2004/0229490 A1 11/2004 Bernat et al.
2005/0037650 A1 2/2005 Hsu et al.
2006/0024985 A1 2/2006 Nagata et al.
2006/0194465 A1 8/2006 Czikora
2006/0258209 A1 11/2006 Hall
2007/0026698 A1 2/2007 Rosenberger
2009/0149086 A1 6/2009 Dahms
2009/0186495 A1 7/2009 Taylor
2009/0215295 A1 8/2009 Tseng
2009/0239422 A1 9/2009 Fukazawa et al.
2009/0264008 A1 10/2009 Matsuda et al.
2010/0007441 A1 1/2010 Yagisawa et al.
2010/0075536 A1 3/2010 Kubo
2011/0151714 A1 6/2011 Flaherty et al.
2011/0237123 A1 9/2011 Burris et al.
2011/0237124 A1 9/2011 Flaherty et al.
2012/0295478 A1 11/2012 Mrowka
2014/0193995 A1 7/2014 Barthelmes et al.
2014/0206218 A1 7/2014 Liu et al.
2015/0118899 A1 * 4/2015 Hugel ..... H01R 24/542 439/578
2015/0118904 A1 * 4/2015 Baechle ..... H01R 12/716 439/591
2015/0126054 A1 * 5/2015 Hoyack ..... H01R 12/91 439/246
2015/0132976 A1 * 5/2015 Sato ..... H01R 4/028 439/74

* cited by examiner

FIG. 9A
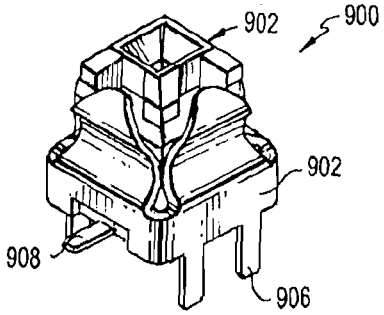
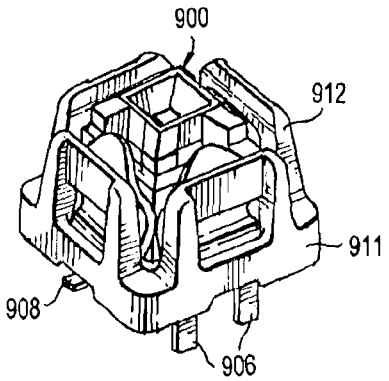
FIG. 9B

FLOAT ADAPTER FOR ELECTRICAL CONNECTOR

RELATED APPLICATION

This application is a continuation-in-part of and claims the benefit of application Ser. No. 13/737,375, filed Jan. 9, 2013, the subject matter of which is incorporated by reference herein.

FIELD OF THE INVENTION

The present invention relates to a float adapter for an electrical connector, particularly for board-to-board connections.

BACKGROUND OF THE INVENTION

A radio frequency (RF) connector is an electrical connector designed to work at radio frequencies in the multi-megahertz range. Typically, RF connectors are used in a variety of applications such as wireless telecommunications applications, including WiFi, PCS, radio, computer networks, test instruments, and antenna devices. In some instances, a number of individual connectors are ganged together into a single, larger connector housing for electrically and physically connecting two or more printed circuit boards.

One example of an RF connector interface is the subminiature push-on (SMP) interface. SMP is commonly used in miniaturized high frequency coaxial modules and is offered in both push-on and snap-on mating styles and is often used for PC board-to-board interconnects. For these applications, the conventional SMP interface utilizes a male connector on each of the PC boards and a female-to-female adapter mounted in between to complete the connection. One problem with conventional RF connectors is that such connectors typically do not have the flexibility to customize the degree of axial or radial float between connectors.

Another problem associated with conventional RF connectors is that the density of individual connectors is limited by the shape and design of the adapter. As RF connector applications have begun to require a greater number of individual connections between components, RF connectors using conventional designs have necessarily increased in size to accommodate this. Larger connectors require more physical space in order to provide the necessary contacts, which make the connectors less applicable to high density systems requiring smaller connectors and more expensive to produce.

Accordingly, there is a need for an electrical connector, such an RF connector, with improved axial and radial float while also having a smaller profile.

SUMMARY OF THE INVENTION

Accordingly, the present invention provides a float adapter for an electrical connector that includes a conductive shell and an insulator received in the conductive shell. The insulator includes an engagement end, an interface end that is opposite the engagement end, and a reduced diameter middle portion therebetween. The insulator includes an inner bore that extends through the engagement end, the interface end, and the reduced diameter middle portion. The interface end has a lead-in tip portion that extends outside of the first end of the conductive shell. The lead-in tip portion has a tapered outer surface that terminates in an end face surface and a shoulder remote from the end face surface that defines an outer diameter that is larger than the inner diameter of the conductive shell. The reduced diameter middle portion defines an annular space between the insulator and the conductive shell. An inner contact is received in the inner bore of the insulator. The inner contact has socket openings at either end.

The present invention may also provide an electrical connector assembly that includes a first connector that has at least one contact that extends into at least one cavity and a second connector that has at least one contact that extends into at least one cavity. At least one float adapter couples the first and second connectors. The float adapter includes_a conductive shell that has opposite first and second ends. The first end has an engagement member configured to engage a corresponding engagement member in the cavity of the first connector. An insulator is received in the conductive shell. The insulator includes an engagement end and an interface end opposite the engagement end. An inner bore extends through the engagement and interface ends, and the reduced diameter middle portion. The interface end has a lead-in tip portion extends outside of the first end of the conductive shell. The lead-in tip portion has a shoulder that defines an outer diameter that is larger than the inner diameter of the conductive shell. The reduced diameter middle portion defines an annular space between the insulator and the conductive shell. An inner contact is received in the inner bore of the insulator. The inner contact has first and second contacts at either end thereof for connecting with the contacts of the first and second connectors, respectively. The at least one float adapter provides axial and radial float between the first and second connectors.

The present invention may further provide an electrical connector assembly that includes a first connector that has at least one first pin contact that extends into at least one first cavity and a second connector that has at least one second pin contact that extends into at least one second cavity. At least one float adapter couples the first and second connectors. The float adapter includes a conductive shell that has opposite first and second ends. The first end has a lip configured to engage a corresponding groove in the first cavity of the first connector. An insulator is received in the conductive shell. The insulator includes an engagement end, an interface end opposite the engagement end, a reduced diameter middle portion therebetween, and an inner bore that extends through the engagement end, the interface end, and the reduced diameter middle portion. The interface end has a lead-in tip portion that extends outside of the first end of the conductive shell. The lead-in tip portion has a tapered outer surface that terminates in an end face surface. A shoulder is remote from the end face surface that defines an outer diameter that is larger than the inner diameter of the conductive shell. The reduced diameter middle portion defines an annular space between the insulator and the conductive shell. An inner contact is received in the inner bore of the insulator. The inner contact has first and second socket openings at either end thereof for connecting with the first and second pin contacts, respectively. The at least one float adapter provides axial and radial float between the first and second connectors.

The present invention may yet further provide a method of assembly of a float adapter that has the steps of providing a conductive shell that has first and second ends; providing an insulator, the insulator has an engagement end, an interface end opposite the engagement member, a reduced diameter middle portion therebetween, and an inner bore extending through the engagement end, the interface end, and the reduced diameter middle portion; inserting the insulator into the conductive shell through the first end of the conductive shell; providing an inner contact that has first and second contact at either end thereof; and inserting the inner contact through the second end of the conductive body and into the inner bore of the insulator.

Other objects, advantages and salient features of the invention will become apparent from the following detailed description, which, taken in conjunction with the annexed drawings, discloses a preferred embodiment of the present invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 9A is a perspective view of yet another alternative high float bullet sub-assembly, according to an exemplary embodiment of the present invention;

FIG. 9B is a perspective view of the high float bullet sub-assembly that includes a housing to help center the bullet and provide additional retention;

DETAILED DESCRIPTION OF THE INVENTION

Figure 1:
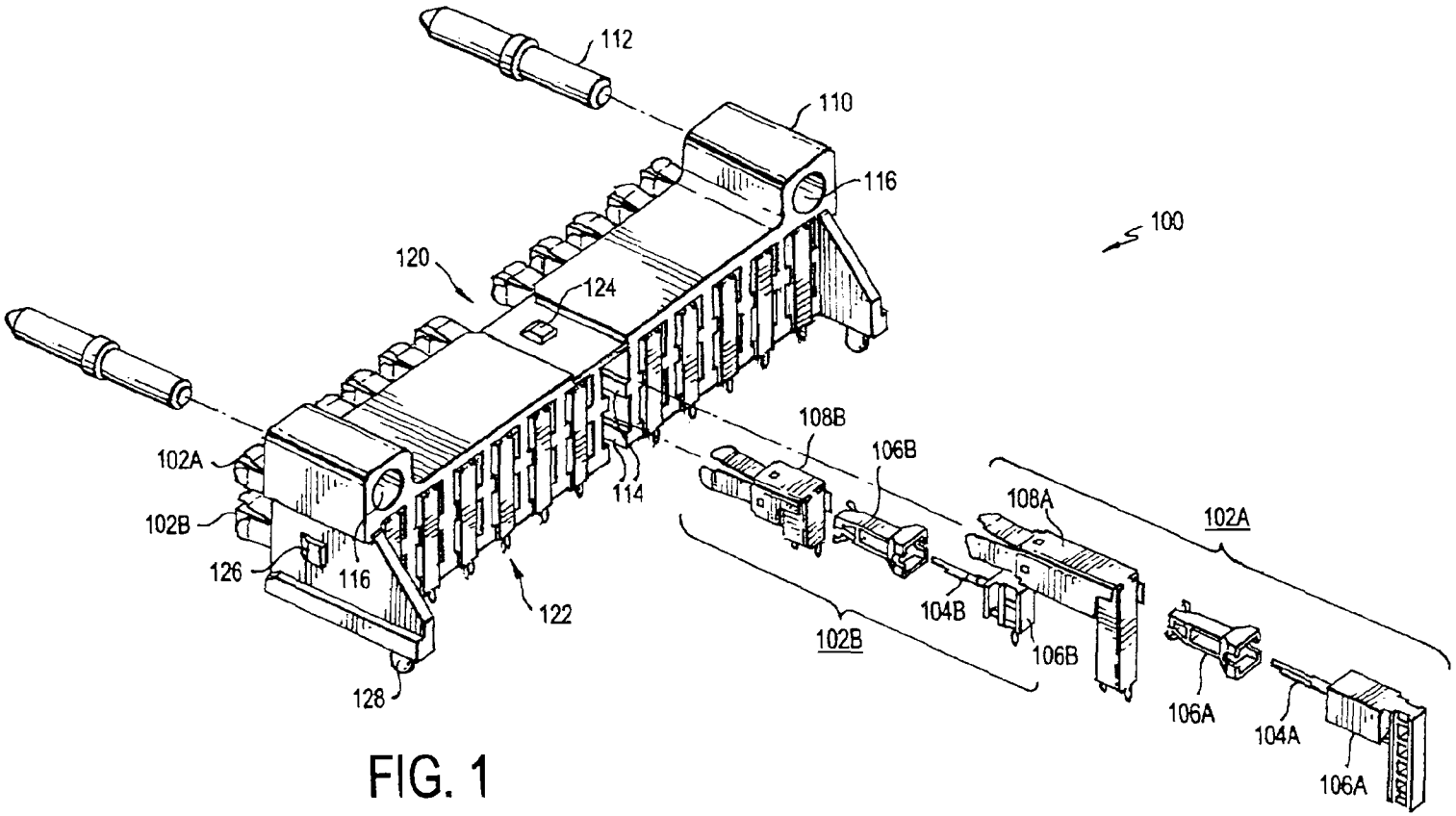
FIG. 1 is an exploded perspective view of a right angle PCB plug assembly according to an exemplary embodiment of the present invention.

Several preferred embodiments of the invention are described for illustrative purposes, it being understood that the invention may be embodied in other forms not specifically shown in the drawings.

The subject matter described herein relates an electrical connector, such as a radio frequency (RF) connector, that is applicable to high density gang-mate printed circuit board PCB-to-PCB solutions in either high float or low float configurations, where float is the tolerance of physical movement or misalignment compensation of the connectors once mated in a fixed position. More specifically, the present invention provides a connector that may have a protruding insulator from a plug interface thereof that has a narrowing shape, such as a pyramid or "dart" shaped lead-in geometry at its tip. Additionally, the present invention includes a bi-gender bullet that has a plug interface on one end and a receptacle interface on the opposite end for providing modular add-on float capability between connectors.

Regarding the first aspect of the present invention, a dart shaped insulating material protrudes from an outer metal housing and protects a recessed, inner contact to facilitate gathering. As used herein, gathering is the process of aligning a plug and a receptacle during the mating process. For example, gathering may include inserting the tip of the plug into a cone (or other) shaped receptacle of the receptacle. Selection of specific shapes of both the tip of the plug and the receptacle aids in aligning the tip to the center of the receptacle through physical contact with the cone and redirection of the insertion forces to a desired position. The present invention is an improvement over the prior art at least in that, by using the protruding insulator for gathering, the geometry of the plug interface required to gather shrinks, and thus a smaller lead-in geometry is possible on the mating receptacle interface.

Another advantage of the present invention is that the inverted pyramid gathering feature on the receptacle insulator aids with blind mate gathering (plugging the connector into a board without human intervention) of the receptacle center contact pin. Yet another advantage of the present invention is that the insulator on the plug provides closed entry protection for female contact on the plug. In other words, it may prevent unwanted contact between the inner contact portion and other portions of the plug (e.g., the outer casing) or portions of the mating receptacle interface.

Regarding the second aspect, the present invention is an improvement over the prior art at least in that the bi-gender bullet allows for increasing the amount of mechanical float between a male and female connector assembly simply by adding the bi-gender bullet between the connectors. Low-float configurations are made by directly mating a male and a female connector without using a bullet therebetween. Thus, the bi-gender bullet of the present invention allows for selecting between low-float and high-float configurations without requiring a change in the gender of either of the connectors. This modular design allows for simpler, cheaper, and more flexible connector products that may use either high float or low float configurations. In contrast, most conventional designs require that the mating connectors have the same interface for high-float configurations.

A bullet according to the present invention may be retained on the standard plug interface with a plastic carrier housing that snaps onto the plug housing. The snap-on feature on the plug housing converts any non-bulleted solution to one having one or more bullets added for additional radial float between connectors.

Turning now to FIG. 1, FIG. 1 depicts an exploded view of an exemplary right-angle PCB plug assembly 100 according to the present invention. This is referred to as a right angle solution because the connector pins located within the plug assembly 100 are bent at ninety degree angles to allow for connecting two PCBs located coplanar or at a right angle to one another when mated with an appropriate corresponding receptacle assembly. It is appreciated that connectors can be either a plug or a receptacle (i.e., male or female) and either a right angle or straight configuration, or any combination thereof. For simplicity of discussion, the subject matter described herein will illustrate and describe a subset of the total number of these possible permutations. However, this is not intended to limit the present invention to any particular combination thereof.

As used herein, the term "contact sub-assembly" refers to an individual connector that includes at least a contact portion, but may also include an insulator portion and a ground body portion, for physically and electrically interfacing with another connector or a PCB. As shown in FIG. 1 this includes a contact sub-assembly 102A (tall right angle configuration) and 102B (short right angle configuration), for example. The term "plug assembly" or "plug" refers to a physical grouping of contact sub-assemblies within a housing having a male interface for connecting to a female interface of a receptacle assembly. The term "receptacle assembly" or "receptacle" refers to a grouping of female interfaces within a housing for receiving a male interface of a plug assembly. The term "connector assembly" refers to a mated combination of a plug assembly and a receptacle assembly or a mated combination of a plug assembly, a receptacle assembly, and a high-float bi-gender bullet option.

The plug assembly 100 preferably includes two rows of contact sub-assemblies 102A and 102B. It is appreciated, however, that other configurations of the contact sub-assemblies may be used without departing from the scope of the subject matter described herein. For example, a single row, three or more rows, and staggered rows of the contact sub-assemblies may be located in the housing 210. The contact sub-assembly 102A may include a contact 104A comprising a conductive material, such as copper, hardened beryllium copper, gold- or nickel-plating, and the like for carrying electrical signals. The contact 104A may be bent at a right angle in the configuration shown; however, it is appreciated that other configurations, such as straight, may also be used without departing from the scope of the subject matter described herein. The contact 104A is preferably enclosed within an outer insulator 106A that has two parts, where a first part is configured to encase the portion of the contact 104A which is bent at the right angle, and a second part which is detachable from the first part and configured to be inserted into a receptacle as will be described in greater detail below. The contact 104A and the insulator 106A may be inserted into a ground body 108A which may be made of a conductive material or materials, such as phosphor bronze and/or selective gold- or nickel-plating, and the like.

Like the contact sub-assembly 102A, the contact sub-assembly 102B also comprises a combination of a contact 104B that is located inside of an insulator 106B, both of which are located inside of a ground body 108B. However, in contrast to the contact sub-assembly 102A, the length of the contact 104B that connects to the PCB may be shorter than the contact 104A in order to adjust for the location of the contact sub-assembly 102A on the top row of the housing 110 and the contact sub-assembly 102B on the bottom row of the housing 110. In other words, in order for all of the contact portions 102A and 102B to extend substantially equally in length into the PCB (not shown), the contacts associated with each row may be different lengths because the bottom row of the housing 110 may be located closer to the PCB than the top row.

A plurality of the contact sub-assemblies 102A or 102B may be secured together in a housing 110. The housing 110 may be made, for example, from 30% glassed-filled polybutylene terephthalate (PBT), which is a thermoplastic polymer. The housing 110 may include a plurality of holes 114 preferably in a grid-like pattern for receiving the individual contact sub-assemblies 102A or 102B. The contact sub-assemblies 102A and 102B extend through the holes 114 to define a plug interface 120 on a first end of the housing 110 and a PCB interface 122 on the other end. The housing 110 may also include one or more guide pin holes 116 for receiving stainless steel guide pins 112. The guide pins 112 may be used to securely physically connect the plug assembly 100 to other receptacle assemblies or high-float option bullet adapters, which will be described in greater detail below.

The plug housing 110 may also include various features for securing to a high float bullet adapter or receptacle. For example, one or more nubs 124 may protrude from the top portion of the housing 110 and be made of the same material as the housing 110 (e.g., plastic). Similarly, one or more nubs 126 may be located on opposite sides of the housing 110 that are different from the plug interface 120 and the PCB interface 122. The nubs 124 and 126 may be received by a corresponding nub loop located on a high float bullet adapter, which will be described in greater detail with respect to FIG. 4.

Figure 2:
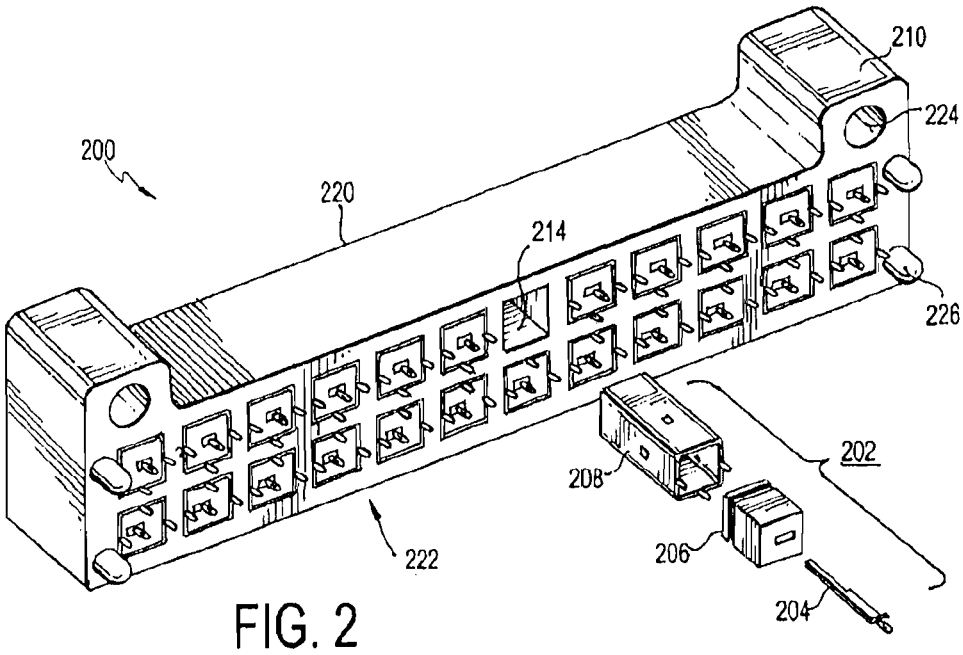
FIG. 2 is an exploded perspective view of a straight PCB receptacle assembly according to an exemplary embodiment of the present invention.

Turning to FIG. 2, a straight receptacle 200 is shown to illustrate an exemplary receptacle connector capable of interfacing with the plug 100. It is appreciated that a right angled receptacle may also be used for interfacing with the right angled plug 100, as is shown in FIG. 7A. The receptacle assembly 200 may include a plurality of contact sub-assemblies 202 for interfacing with a plug assembly, such as plug assembly 100. The receptacle contact sub-assemblies 202 are preferably provided in rows to define a receptacle interface 220 and a PCB interface 222 on the opposite side of the housing 210. Each contact sub-assembly 202 may include a contact 204, an insulator 206, and a ground body 208. The receptacle contact sub-assemblies 202 may contain similar materials and may be manufactured using similar processes as the contact sub-assemblies 102A and 102B in order to be electrically and mechanically compatible. Similar to the plug assembly 100, the receptacle contact sub-assemblies 202 are located in the holes 214 of the housing 210 for producing the receptacle assembly 200.

Guide pin holes 224 may be located in the housing 210 for receiving guide pins (not shown in FIG. 2) for securing together the receptacle housing 210 and the plug housing 110. The receptacle housing 210 may also include one or more nubs protruding from the PCB interface 222 side of the housing 210 for securing the receptacle housing 210 with the PCB (not shown). This allows for little or no axial movement between the receptacle housing 210 and the PCB which helps prevent damaging the contact pins 204.

Figure 3:
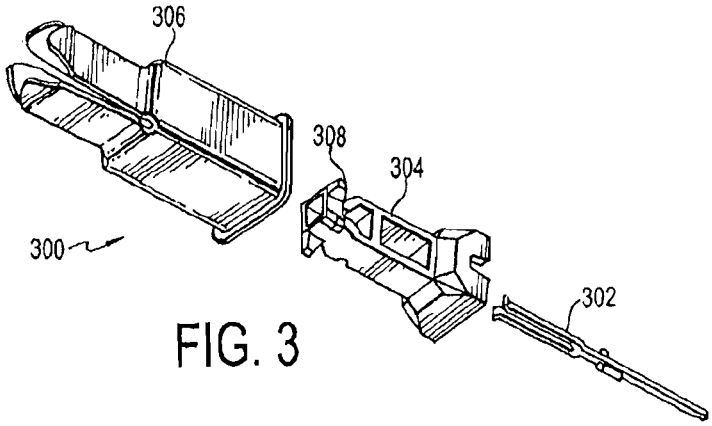
FIG. 3 is an exploded perspective view of an exemplary high float bullet sub-assembly according to an exemplary embodiment of the present invention.

FIG. 3 is an exploded view of an exemplary high-float bi-gender bullet sub-assembly according to the present invention. Referring to FIG. 3, each high-float bullet sub-assembly 300 is an adapter that includes a contact 302, an inner insulator 304, and an outer ground body 306. The contact 302 may comprise a conductive material, such as copper, hardened beryllium copper, gold- or nickel-plating, and the like for carrying electrical signals. The contact 302 is enclosed within the insulator 304 that is configured to encase the contact 302. The contact 302 and the insulator 304 may be inserted into the ground body 306. The ground body 306 may be made of a conductive material, such as phosphor bronze and/or selective gold- or nickel-plating, and the like.

Each individual bullet sub-assembly 300 is configured such that the insulator 304 preferably extends beyond the contact 302 and ground body 306 and thus protrudes from its interface at its end 308. The end 308 preferably has a lead-in geometry, such as a substantially square-based pyramid, or "dart", shape. This geometry for the insulator portion 304 is preferably narrow to allow for ganging closer together a plurality of the individual bullet sub-assemblies 300 in a more compact housing. However, it is appreciated that other lead-in geometries may be used for the insulator portion 304 without departing from the scope of the subject matter described herein.

Figure 4:
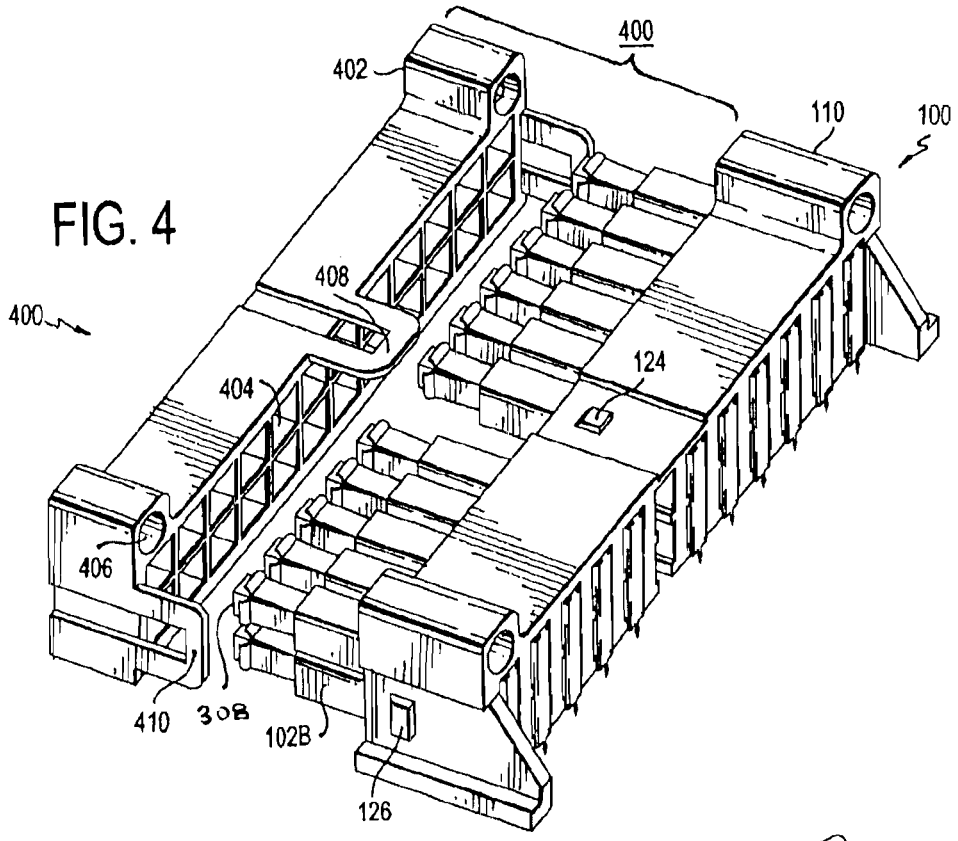
FIG. 4 is an exploded perspective view of the right angle PCB plug illustrated in FIG. 1, shown with a high float bullet option according to an embodiment of the present invention.

FIG. 4 shows an exploded view of the plug assembly 100 with a high float bullet option according to an exemplary embodiment of the present invention. Referring to FIG. 4, a plurality of the high-float bullet sub-assemblies 300 may be connected to each of the contact sub-assemblies 102A and 102B on the plug 100 and held together in an adapter housing 402 in order to create the high float bullet option 400 for the plug. Once the female end of the high float bullet option 400 has been connected to the plug 100, the male end of the high float bullet option 400 may be connected to the female end of the receptacle 200 in order to create a complete right angle-to-straight connector assembly including the high float bullet option 400. Thus, a connector assembly including the mated plug 100 and the receptacle 200 with no float therebetween may be converted to a high-float configuration by inserting the bi-gender bullet option 400 therebetween. Because the high float bullet option 400 is bi-gender, no changes are required to either the plug 100 or the receptacle 200 in order to convert from a no or low float configuration to a high float configuration.

The high float bullet adapter housing 402 may include a plurality of holes 404 preferably in a grid-like pattern for receiving the high-float bullet sub-assemblies 300. The high-float bullet sub-assemblies 300 extend through the holes 404 to connect the plug 100 to the receptacle 200. The high float bullet adapter housing 402 may also include one or guide pin more holes 406 for receiving guide pins 112. The guide pins 112 may be used to securely physically connect the plug assembly 100 to the high-float option bullet adapter 400. The guide pins 112 may be formed of stainless steel, for example.

The high float bullet adapter housing 402 may further include nub loops 408 and 410 that extend beyond the face of the holes 404 and correspond to the shape of the nubs 124 and 126 located on the plug 100 for receipt of the same. The nub loops 408 and 410 physically secure the high float bullet adapter housing 402 with the plug housing 110 in a snapping engagement. However, it is appreciated that the attachment for housings 110 and 402 other than the nubs 124-126 and the nub loops 408-410 shown in FIG. 4 may be used without departing from the subject matter described herein.

Figure 5:
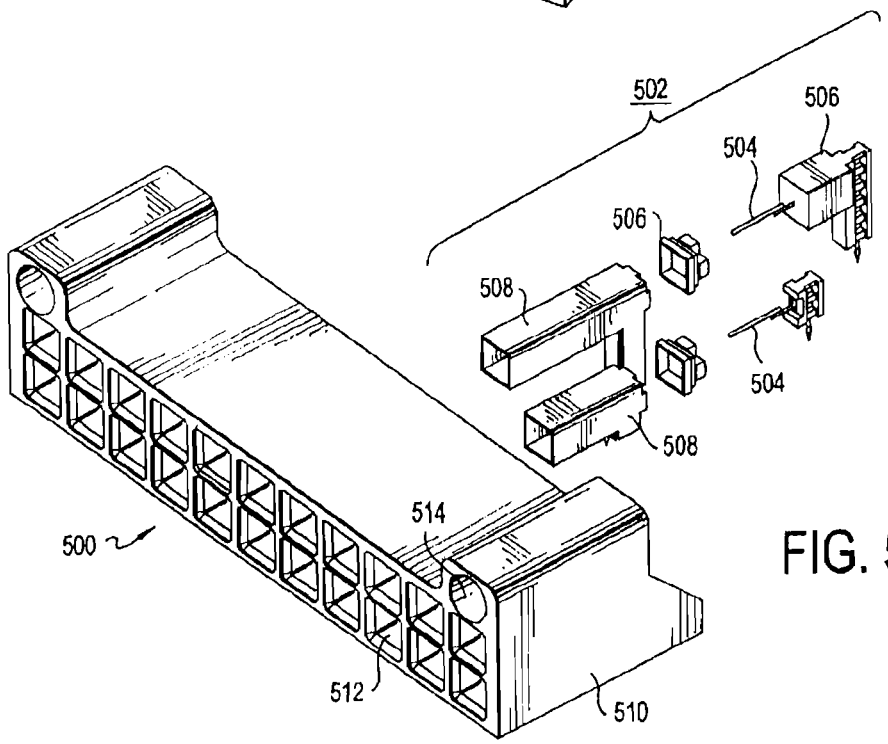
FIG. 5 is an exploded perspective view of an exemplary right angle PCB receptacle assembly according to an embodiment of the present invention.

FIG. 5 is an exploded view of an exemplary right angle receptacle assembly according to an embodiment of the subject matter described herein. The right angle receptacle 500 is an alternative to the straight receptacle 200 shown in FIG. 2. Yet similar to the straight receptacle 200, the right angle receptacle 500 includes a plurality of individual receptacle sub-assemblies 502 for mating with corresponding portions of a plug assembly, such as the plug assembly 100 shown in FIG. 1. The individual receptacle sub-assemblies 502 may each include a contact 504, an insulator 506, and a ground body 508 as described earlier. It is appreciated that the receptacle sub-assemblies 502 may come in a variety of possible shapes/configurations including, but not limited to, the configuration shown in FIG. 5.

Also similar to the straight receptacle configuration 200, the individual receptacle sub-assemblies 502 may be secured together in a housing 510. For example, the housing 510 may include a plurality of holes 512 preferably in a grid-like pattern for receiving the individual receptacle sub-assemblies 502 and the high-float bullet sub-assemblies 300, and/or the plug interface 120 of the plug 100. The receptacle sub-assemblies 502 extend through the holes 512 to connect the plug 100 to the receptacle 200. The housing 510 may also include one or guide pin more holes 514 for receiving the guide pins 112. The guide pins 112 may be used to securely physically connect the receptacle assembly 500 to the high-float option bullet adapter 400. The housing 510 may be formed of plastic and may include additional holes for receiving one or more guide pins for maintaining alignment between connectors. In contrast to the straight receptacle 200, the housing 510 of the right angle receptacle 500 maybe larger than the housing 210 in order to accommodate the increased length associated with the receptacle sub-assemblies 502.

Figure 6A:
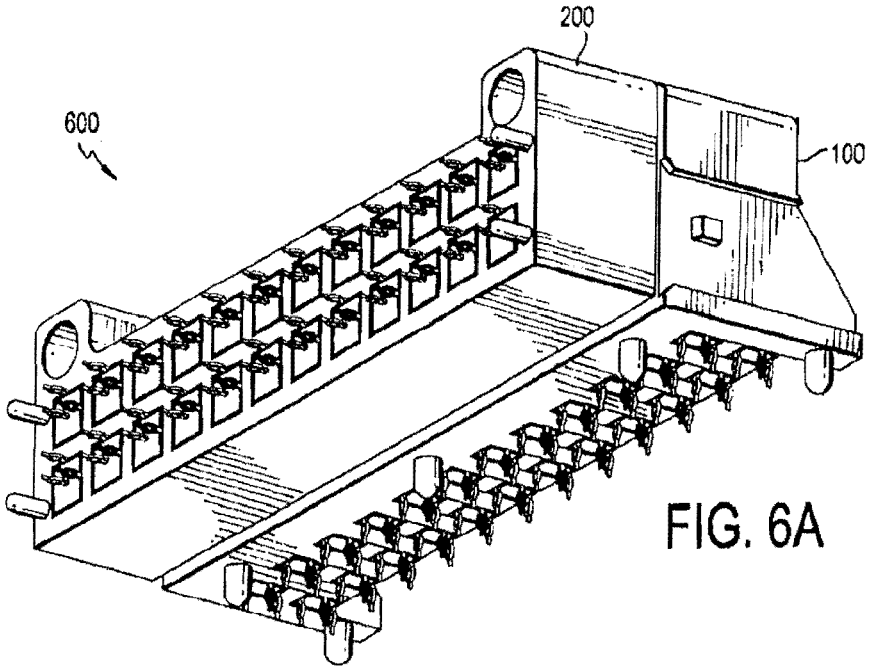
FIG. 6A is a perspective view of the right angle plug illustrated in FIG. 1 mated to the straight receptacle illustrated in FIG. 2, shown as a non-bulleted mated solution according to an embodiment of the present invention.

FIG. 6A is a perspective view of a non-bulleted connector assembly 600 of the plug assembly 100 connected to the receptacle assembly 200 according to an exemplary embodiment of the present invention. Because no bullet is located between the plug assembly 100 and the receptacle assembly 200, no or a low amount of radial float exists between the plug assembly 100 and the receptacle assembly 200. Thus, the non-bulleted connector assembly configuration 600 is shown to illustrate an exemplary no or low-float configuration that is suitable for being modified through the addition of the high float bullet option 400 therebetween, which is shown and described in FIGS. 7A and 7B below.

Figure 6B:
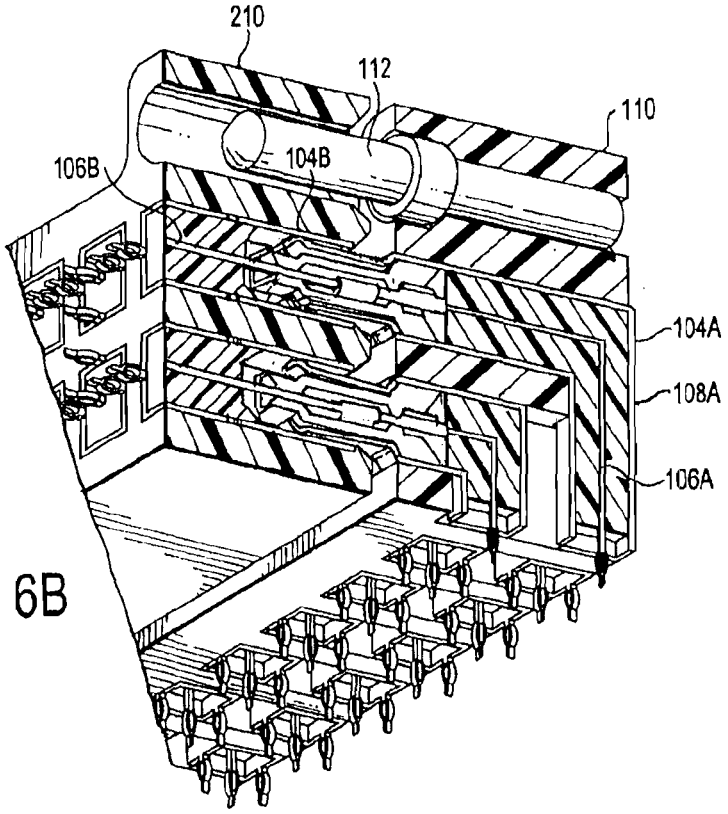
FIG. 6B is an enlarged cut-away view of the right angle plug-to-straight receptacle non-bulleted mated solution shown in FIG. 6A.

FIG. 6B is a zoomed-in cut-away view of the non-bulleted connector assembly 600 shown in FIG. 6A. Referring to FIG. 6B, the right angle plug assembly 100 includes the conductor 106A surrounded by the insulator 104A and the ground body 108A. Similarly, the receptacle assembly 200 includes the conductor 106B surrounded by the insulator 104B and the ground body 108B. The housing 110 and the housing 210 are further secured together by one or more guide pins 112.

In the connector assembly configuration shown in FIG. 6B, it is appreciated that a first PCB (not shown) may be connected to the portions of connector pins 106A extending beyond the housing 110. Likewise, a second PCB (not shown) may be connected to the portions of connector pins 106B extending beyond the housing 210. Because the pins 106A are bent at a ninety degree angle and the pins 106B are straight, the right angle-to-straight connector assembly configuration 600 allow for connecting the first and the second PCBs at a right angle to one another, which may be desirable in certain applications. It will be appreciated that the connector assembly according to the present invention, can be any combination of a right-angle or straight plug assembly mated with a right-angle or straight receptacle assembly.

FIG. 7A is a perspective view of an exemplary right angle plug-to-straight receptacle including a bi-gender high-float bullet adapter option according to an exemplary embodiment of the present invention. Referring to FIG. 7A, the bulleted connector assembly 700 comprises the right angle plug assembly 100, the right angle receptacle 500, and the high float bullet 400 connected therebetween. The high float bullet option 400 provides for a higher amount of radial float between the right angle plug 100 and the right angle receptacle 500 while maintaining the same axial float of the non-bulleted solution.

Figure 7B:
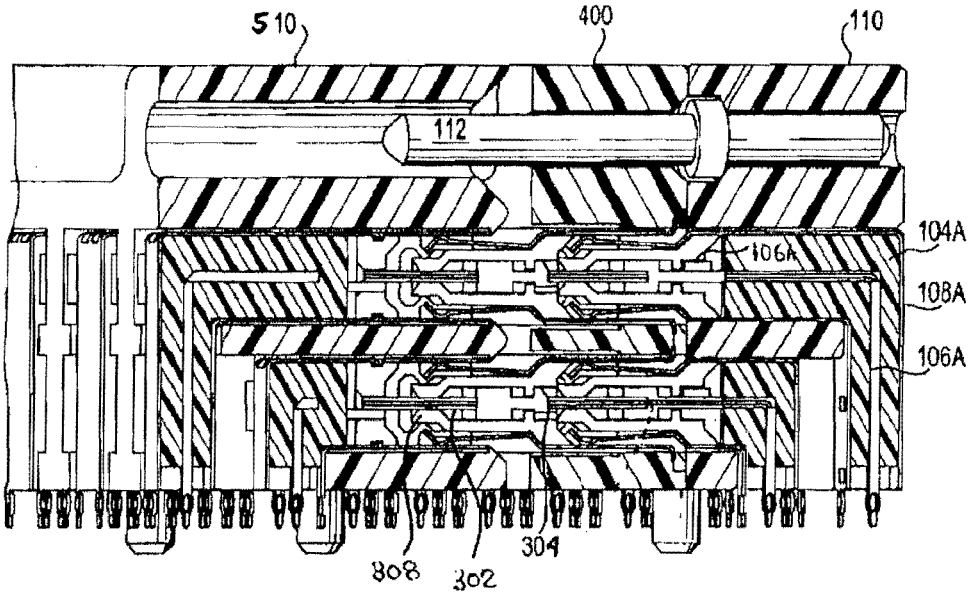
FIG. 7B is an enlarged cut-away side view of the exemplary right angle plug-to-right angle receptacle bulleted mated solution shown in FIG. 7A.
Figure 7A:
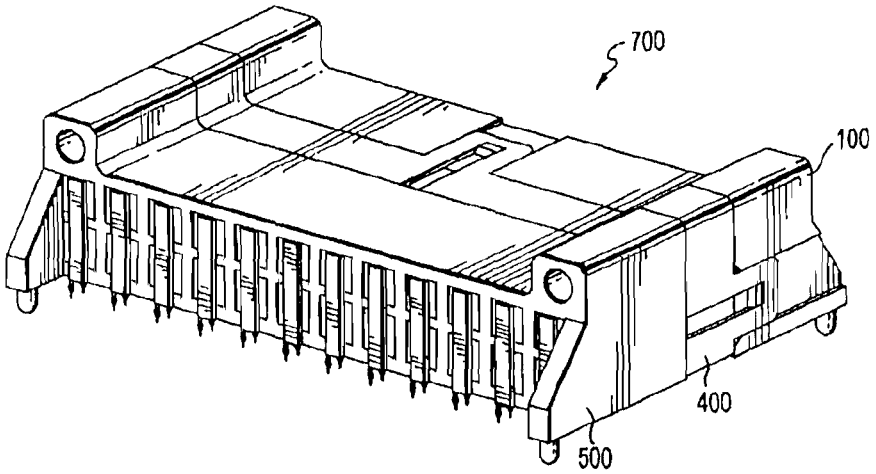
FIG. 7A is a perspective view of the right angle plug assembly illustrated in FIG. 1 mated to the right angle receptacle assembly illustrated in FIG. 5, shown as a bulleted mated solution according to an embodiment of the present invention.

FIG. 7B is an enlarged cut-away side view of the exemplary right angle plug-to-right angle receptacle bulleted solution shown in FIG. 7A. Referring to FIG. 7B, the components of the right angle plug assembly 100 include the conductor 106A surrounded by the insulator 104A and the ground body 108A. Similarly, the right angle receptacle assembly 500 includes a plurality of receptacle sub-assemblies 502 each comprising the conductor 504 surrounded by the insulator 506 and the ground body 508. The plug housing 110 is further secured to the receptacle housing 510 by the guide pin 112, which runs through the guide pin hole 402 of the bullet adapter housing 400. It will be appreciated that the connector assembly according to the present invention, can be any combination of a right-angle or straight plug assembly mated with a right-angle or straight receptacle assembly.

As described above, the high float bullet adapter 400 includes a plurality of high-float bullet sub-assemblies 300 for interfacing between the male portion of the plug 100 and the female portion of the receptacle 500, where each high-float bullet sub-assembly 300 comprises the conductor 302, the insulator 304, and the ground body 306. Because the high float bullet adapter 400 can be designed to be compatible with the configurations of the plug 100 and the receptacle 500, the high float bullet adapter 400 may be inserted or removed from between the plug assembly 100 and the receptacle assembly 500 in order to easily and quickly convert between high float and low float configurations.

The shape of the high-float bullet sub-assemblies 300 allows for increased axial and radial movement (i.e. float) between the plug and receptacle assemblies and a more compact footprint while maintaining a secure electrical connection. Specifically, the shape of the high-float bullet sub-assemblies 300 includes the insulator 304 of each individual bullet sub-assembly 300 preferably extending beyond the contact 302 and thus protruding from its interface with a substantially square-based pyramid, or "dart", shaped lead-in geometry. This geometry for the insulator portion 304 is smaller than conventional lead-in geometries and allows for ganging closer together a plurality of the individual bullet sub-assemblies 300 in a more compact housing while increasing the degree of float. Each of these advantages over the prior art may be useful in a variety of applications, but particularly in RF connector applications such as wireless telecommunications applications, including WiFi, PCS, radio, computer networks, test instruments, and antenna devices.

Figure 8A:
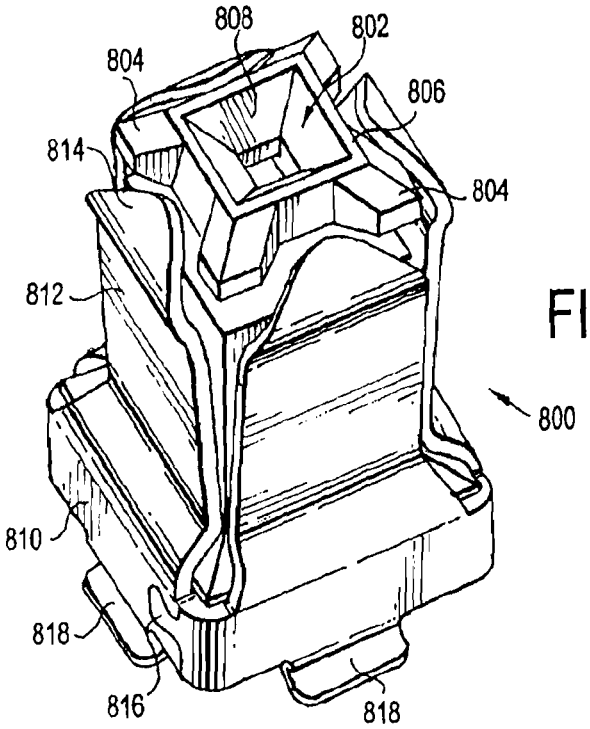
FIGS. 8A and 8B are perspective views of an alternative high float bullet sub-assembly according to an exemplary embodiment of the present invention.
Figure 8B:
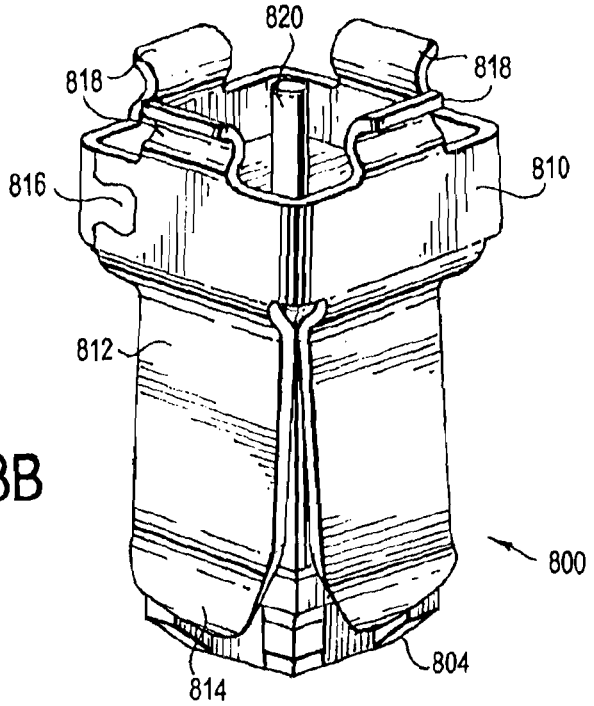

FIGS. 8A and 8B are perspective views of an alternative high float bullet sub-assembly according to an alternative exemplary embodiment of the present invention for providing float between plug and jack assemblies. Similar to the bullet sub-assembly 300, the high float bullet sub-assembly 800 generally includes an inner insulator 802, a contact 820, and an outer ground body 810. The insulator 802 may be made of plastic and preferably has a lead-in geometry at its end 806 that may be a narrowing, substantially pyramid-like shape that extends beyond an outer ground body 810. Each corner 804 of the insulator portion 802 may include a center ridge that extends downward and away from a substantially square rim of the high float bullet sub-assembly 800. Further, the ridge of each corner 804 is flanked by two parallel edges which define the sides of the corner 804 and also extend downward away from the inner rim at the same angle. It is appreciated that other configurations for the insulator portion 802 and/or corners 804, including more or fewer than four corners as well as rounded tip-shapes, may be used without departing from the scope of the subject matter described herein. Inside the rim 806 is an inner substantially square sloping portion 808 which slopes inward toward a center conductor which aids in gathering.

The outer ground body 810, typically made of metal, which surrounds the insulator portion 802 may include four sidewalls 812 corresponding to each side of the insulator portion 802. The tips 814 of the sidewalls 812 may be curved inward toward the center of the bullet 800 and may be located in between the corners 804 of the dielectric portion 802. The outer ground body 810 may be composed as one-piece or multiple pieces secured together with a dovetail joint 816, for example, or any other suitable means. The base 822 of the ground body 810 may further include tail portions 818 on each side in the embodiment shown. Tail portions 818 are preferably curved outwardly, as seen in FIG. 8B.

FIGS. 9A and 9B are perspective views of a plug interface assembly 900 into which the bullet sub-assembly 800 snaps to provide float. The plug interface assembly 900 includes an inner insulator 902 surrounded by an outer ground body 904. The inner insulator 902 and the ground body 904 are shorter and/or smaller than the bullet ground body 810 of the bullet sub-assembly 800. Additionally, the base of the ground body 904 may include a plurality of tail portions 906 for connecting directly to a PCB. The bullet sub-assembly 900 also includes and a contact tab 908 that connects to a PCB.

As seen in FIG. 9B, the plug interface assembly 900 may include an outer housing 910 to help center the bullet on the PCB and provide additional retention according to an exemplary embodiment of the present invention. The housing 910 is preferably plastic and surrounds the ground body 904. The housing 910 includes a base portion 911 from which four loops 912 extend which corresponding to each side of the ground body 904. The loops 912 may be used for additional securing the bullet sub-assembly 800 to the plug interface assembly 900 during maximum radial offset, where the tail portions 818 of the bullet sub-assembly 800 are captivated by the loops 912 preventing the bullet sub-assembly 800 from pulling off of the plug interface assembly 900. However, it is appreciated that other configurations of the loops 912 and the housing 910 may be used without departing from the scope of the subject matter described herein.

Figure 10:
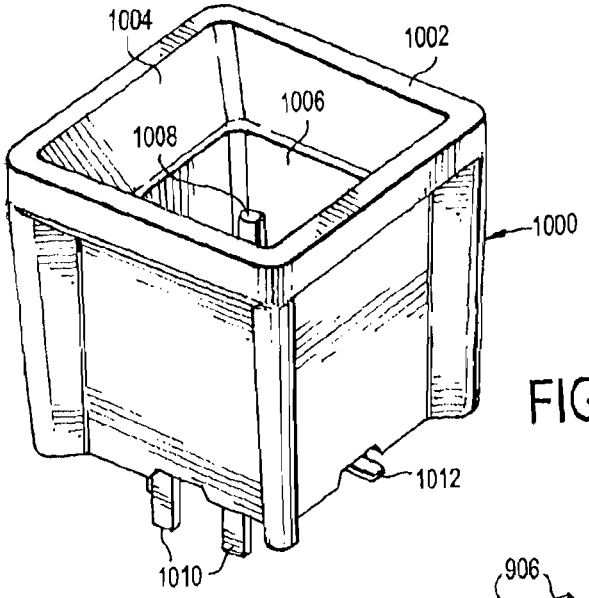
FIG. 10 is a perspective view of a mating component of a high float bullet sub-assembly according to an exemplary embodiment of the present invention; sub-assembly according to an exemplary embodiment of the present invention.

FIG. 10 is a perspective view of a mating jack assembly 1000 for the high float bullet sub-assembly 800 and the plug interface assembly 900 according to an exemplary embodiment of the present invention. The mating jack assembly 1000 includes a housing with a substantially square-shaped outer rim 1002 and an inward and downward sloping, inner surface 1004 for providing a gathering surface to a receiving area 1006. The mating component 1000 includes an outer surface that is connected to the outer rim 1002 and an inner surface that is connected to the inside portion of the inner sloping portion 1004 for defining the inner receiving area 1006. Inside the receiving area 1006 is an inner conductor 1008 which mates to the inner conductor 820 of the bullet sub-assembly 800.

Figure 11:
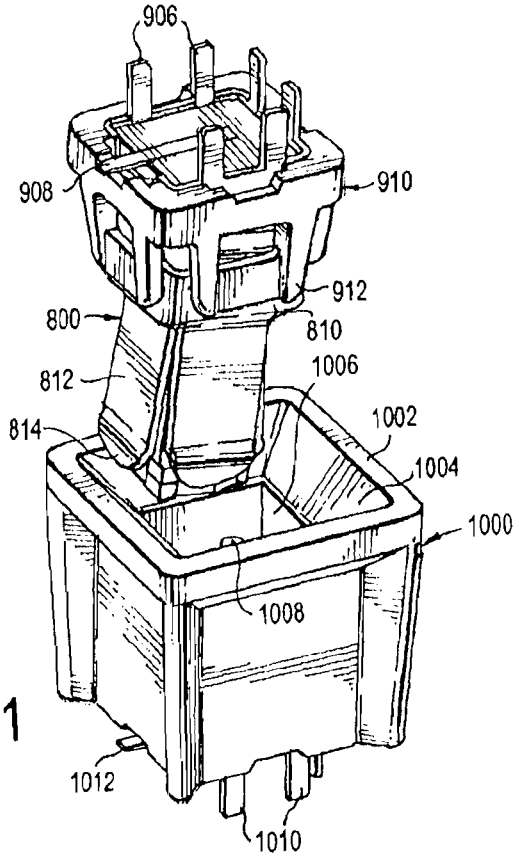
FIG. 11 is an exploded perspective view of the bullet sub-assembly of FIGS. 8A and 8B being mating with the mating component of FIG. 10, showing the process of gathering according to an exemplary embodiment of the present invention.
Figure 12:
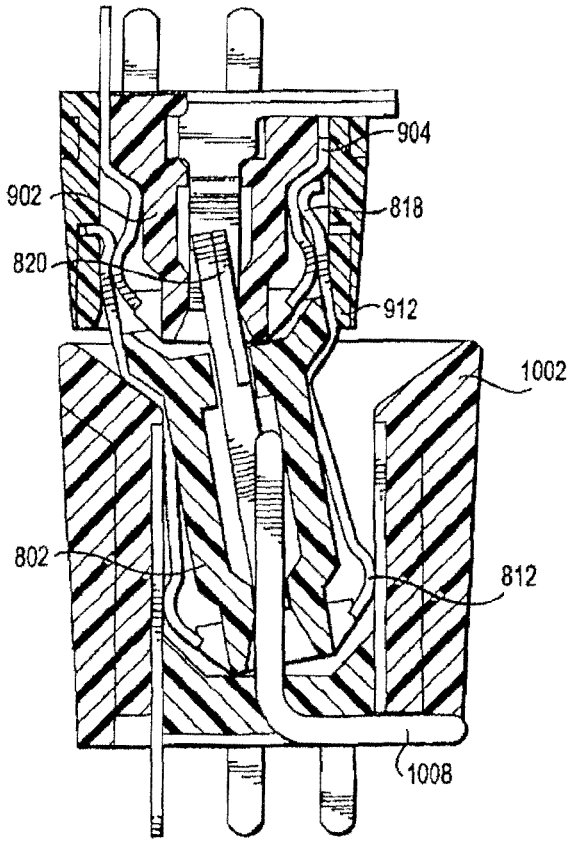
FIG. 12 is cross-sectional view of the components mated, according to an exemplary embodiment of the present invention.

As seen in FIGS. 11 and 12 the high float bullet sub-assembly 800 shown in FIG. 8C on the plug assembly 900 is mated or gathered with the mating jack assembly 1000 where the bullet sub-assembly 800 provides float between the two components at maximum radial offset. The bullet sub-assembly 800 may be supported by outer housing 910. The tail portions 818 of the bullet sub-assembly 800 provide a dual functionality for retention of the bullet 800 onto plug assembly 900. The inward curvature of the bullet tail portions 818 snap into the respective inward curvature 920 of the mating tines on the plug assembly 900. The outward curvature of the bullet tail portions 818 snap into the housing loops 912, preventing the bullet sub-assembly 800 from pulling off of the inward snap when the bullet sub-assembly is at an increased angle with respect to the axis of plug assembly 900. The bullet body 810 is supported and centered by the plug assembly hoops 912. The end of the bullet sub-assembly 800 can be inserted into and gather in the receiving area 1006 of the mating component 1000.

Referring to FIGS. 13-19, an adapter 1300 according to another exemplary embodiment of the present invention is illustrated that provides axial and radial float between the electrical connectors. The adapter 1300 of the present invention is also designed to provide a smaller profile allowing for high density mating. The adapter 1300 may also assist in the blind mating of the connectors. The blind-mate features of the adapter 1300 allow an operator to join the connectors without visually seeing the connector interfaces mate.

Figure 13:
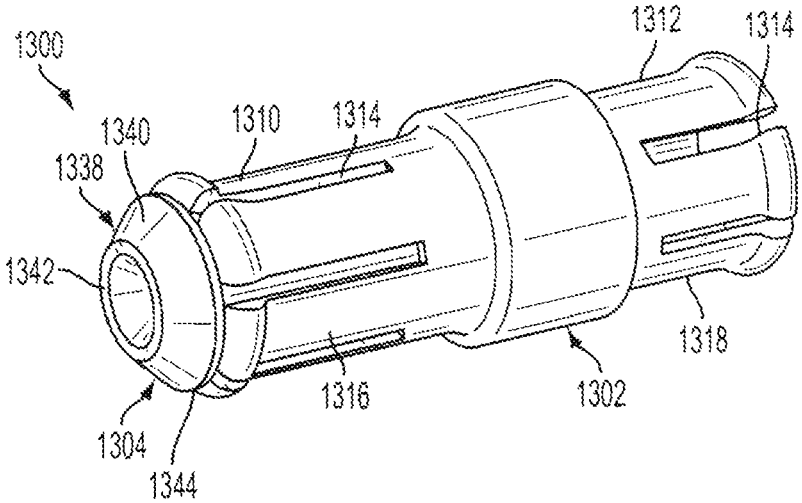
FIG. 13 is a perspective view of a float adapter for an electrical connector in accordance with an exemplary embodiment of the present invention.
Figure 14:
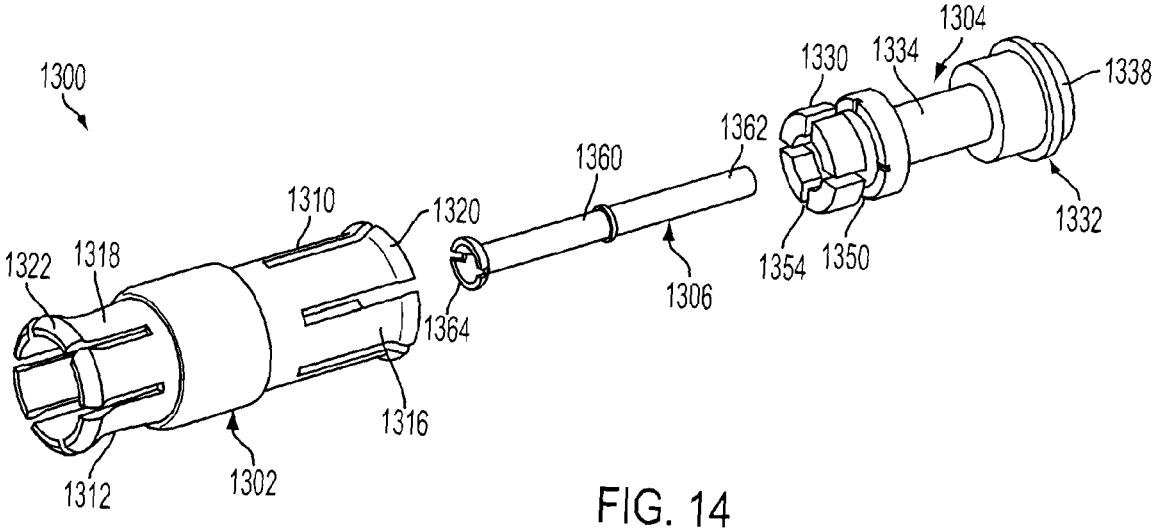
FIG. 14 is an exploded perspective view of the float adapter illustrated in FIG. 13.
Figure 15:
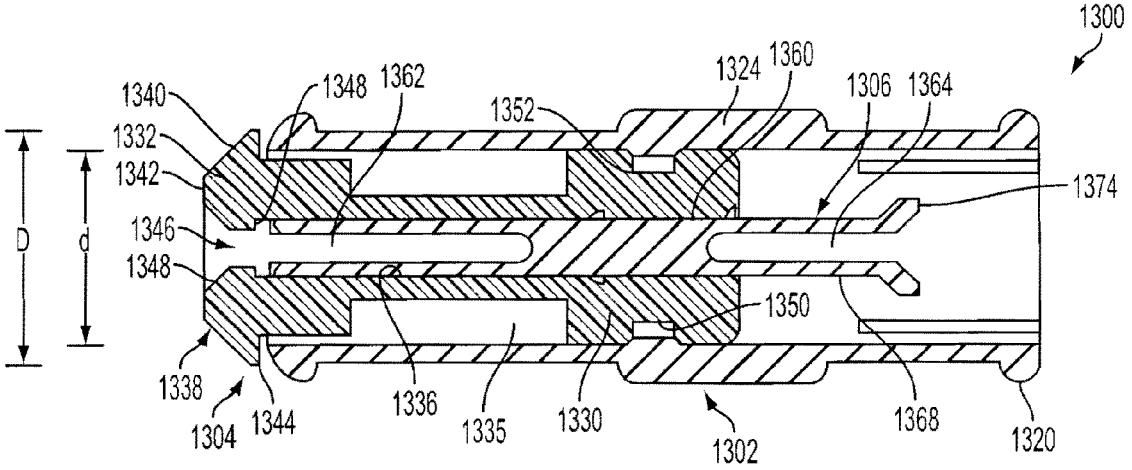
FIG. 15 is a cross-sectional view of the float adapter illustrated in FIG. 13.

As seen in FIGS. 13-15, the adapter 1300 generally includes a conductive shell 1302, an insulator 1304, and an inner contact 1306. The conductive shell 1302 is sized to receive the insulator 1304 and includes opposite first and second ends 1310 and 1312. Both ends 1310 and 1312 include longitudinal slots 1314 that create spring fingers 1316 and 1318 at each shell end. The fingers are flexible to facilitate mating and also enhance electrical connection by continually applying an outer force to the inside of the connector component body in which the adapter is received. The first end 1310 has an annular lip 1320 at its distal end and the second end 1312 has a similar annular lip 1322 at its distal end. The shell 1302 may have a thicker section 1324 between the ends 1310 and 1312 to provide strength to the shell. The thicker section 1324 may provide strength and also assists in manufacture of the adapter. For example, the thicker section 1324 allows the adapter's center portion to be captivated in a collet during machining so that the slots can be cut on both ends thereof. The thicker section 1324 may also limit the amount of tilt the adapter can have within its mating part. That is, the thicker section 1324 may contact the inner diameter of the component body when the adapter is tilted to its maximum position.

The insulator 1304 is received in the conductive shell 1302 and generally includes an engagement end 1330 or engaging the shell 1302, an interface end 1332 that is opposite the engagement end 1330 that extends partially through the first end 1310 of the shell 102, and a reduced diameter middle portion 1334 between the engagement and interface ends 1330 and 1332. A longitudinal inner bore 1336 extends through the insulator 1304, as seen in FIG. 15.

The interface end 1332 has a lead-in tip portion 1338 that extends outside of the first end 1310 of shell 1302 for facilitating mating with a connector. The lead-in tip portion 1338 has a tapered outer surface 1340 terminating in an end face surface 1342. A shoulder 1344 may be provided at the interface end 1332 of the insulator 1304 that is remote from the end face surface 1342. The shoulder 1344 preferably provides an outer diameter D (FIG. 15) that is larger than the inner diameter d of the shell 1302. The outer diameter D helps to guide the adapter into the mating connector component without letting the front tip of the fingers contact the mating connector component, only the outer diameter which provides electrical contacts. That avoids damage to the fingers. The end face surface 1342 of the insulator's interface end 1332 includes an interface opening 1346 in communication with the inner bore 1336. The interface opening 1346 preferably has an inner surface 1348 that tapers inwardly toward the inner bore 1336 to facilitate acceptance of a contact. Also at the interface opening 1346 of the interface end 1332 is an inner stopping shoulder 1348.

The engagement end 1330 of the insulator 1304 has an outer diameter than is preferably substantially the same as the inner diameter of the conductive shell 1302, as seen in FIG. 15. An engagement member, such as an outer annular groove 1350 is provided in the middle of the engagement end 1330 that is sized to engage a corresponding engagement member, such as an annular flange 1352 on the inside of the shell 1302. A number of slots 1354 (FIG. 14) may be provided in the insulator's engagement end 1330 allowing the engagement end 1330 to slightly expand when engaging its groove 1350 with the flange 1352 of the shell 1302.

The reduced diameter middle portion 1334 of the insulator 1304 has a width significantly less than the engagement end 1330 and interface end 1332, thereby defining an open annular area or space 1335 between the reduced diameter middle portion 1334 and the inner surface of the conductive shell 1302. The annular space 1335 allows for proper impedance through the adapter.

The inner contact 1306 is received in the inner bore 1336 of the insulator 1304 generally along the central longitudinal axis of the adapter 1300. The inner contact 1306 generally includes a body 1360 that has first and second socket openings 1362 and 1364 at either end 1366 and 1368 thereof. The socket openings 1362 and 1364 are adapted to accept mating pin contacts. Each end of the body 1360 may also include slots 1370 and 1372, respectively, to provide flexibility to the sockets 1362 and 1364. One end 1368 of the inner contact 1306 extends through the engagement end 1330 of the insulator 1304. That end 1368 may include a flared portion 1374. Because there is no insulator on this side of the adapter, the flared portion 1374 provides a similar function as inner stopping shoulder 1348, which helps ensure the mating contact is guided into proper mating condition.

The float adapter 1300 of the present invention is preferably assembled by inserting the insulator 1304 into the conductive shell 1302 through its first end 1310 and inserting the inner contact 1306 through the second end 1312 of the conductive body 1302 and into the inner bore 1336 of the insulator 1306. The insulator 1304 may be inserted into the conductive shell 1302 until the groove 1350 of the insulator 1304 and the corresponding flange 1352 of the conductive shell 1302 snap together. The inner contact 1306 is preferably inserted into the internal bore 1336 of the insulator 104 until the contact 1306 abuts the inner stopping shoulder 1348 of the insulator 104.

Figure 16:
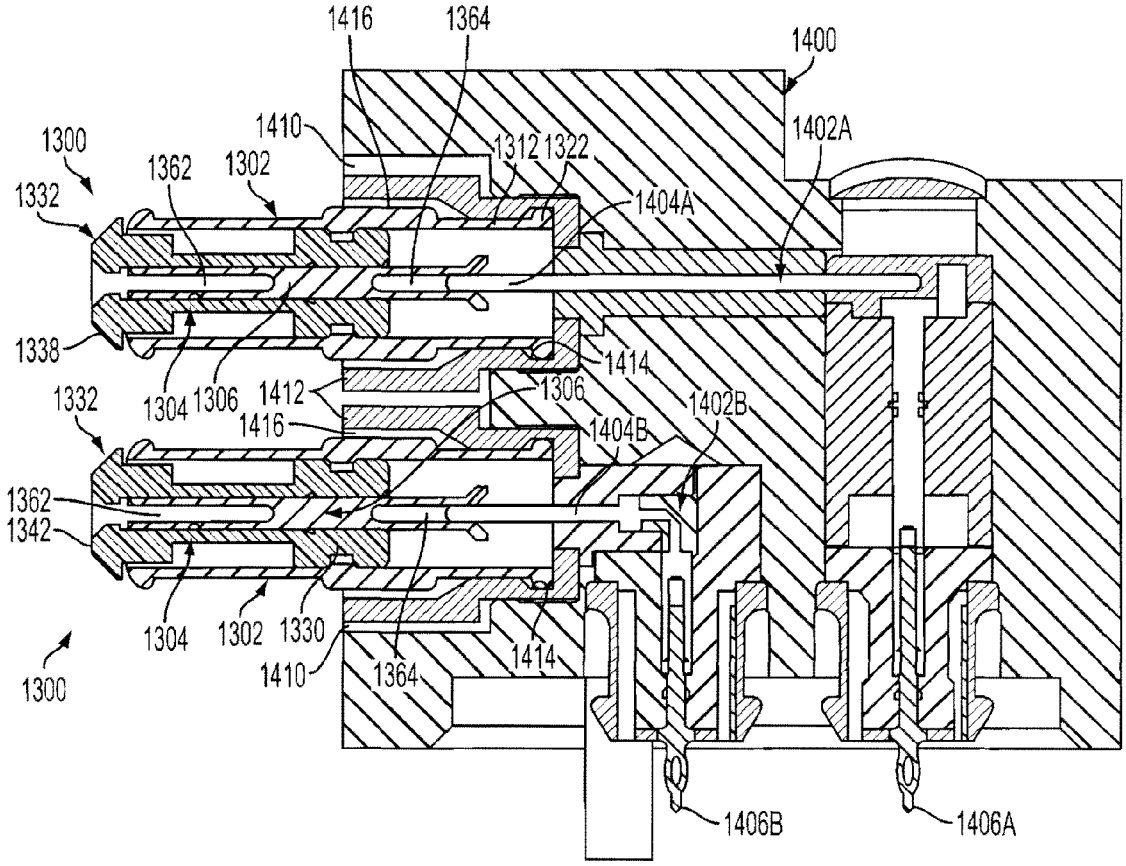
FIG. 16. is a cross-sectional view of an electrical connector in accordance with an exemplary embodiment of the present invention, showing the electrical connector with the float adapter illustrated in FIG. 13.

FIG. 16 illustrates two of the float adapters 1300 mated with a first connector 1400. Although two float adapters 1300 are shown, any number of float adapters 1300 may be used, including only one. The connector 1400 preferably includes a body with a plurality of contacts 1402A and 1402B. Each contact 1402A and 1402B has a pin end 1404A and 1404B and a tail end 1406A and 1406B. The pin ends 1404A and 1404B are adapted to engage the second socket openings 1364 of the adapters' inner contacts 1306. The opposite tail ends 1406A and 1406B are adapted to engage a printed circuit board.

The body of the connector 1400 includes two cavities 1410 that each accepts the second end 1312 of the adapter's shell 1302. Each cavity 1410 includes a conductive shield or bushing 1412. Each conductive shield 1412 preferably includes an annular groove 1414 that couples with the annular lip 1322 of each adapter shell's second end 1312. Each cavity 1410 includes a widened area 1416 that facilitates radial float movement of the adapters 1300.

Figure 17:
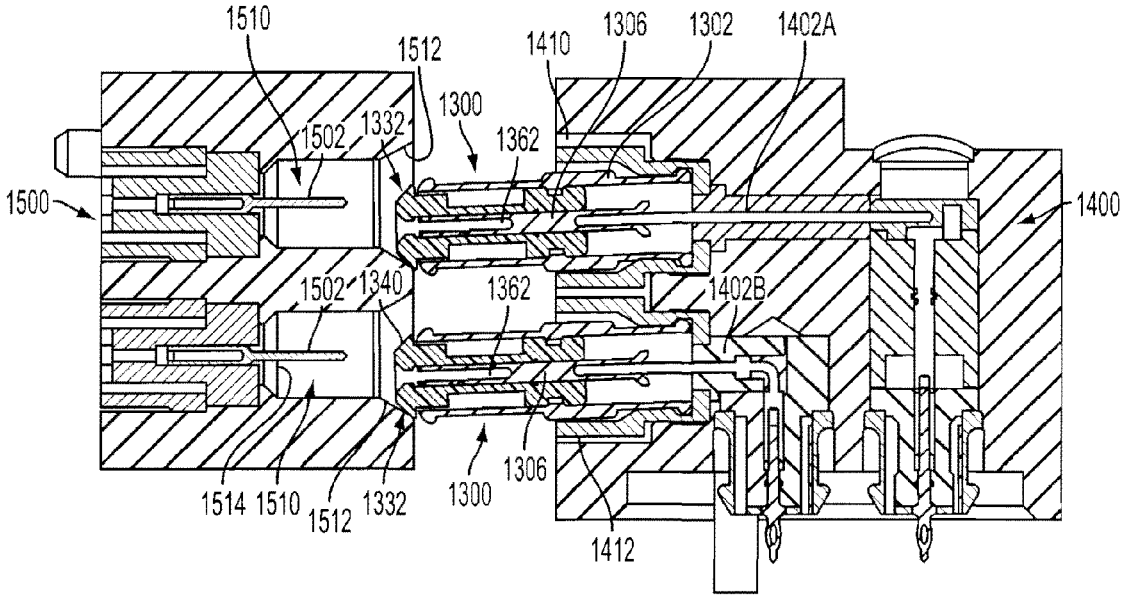
FIG. 17 is a cross-sectional view of an electrical connector assembly in accordance with an exemplary embodiment of the present invention, showing the blind mating of two electrical connector component using the float adapter illustrated in FIG. 13.

FIG. 17 illustrates the initial mating of the connector 1400 with a second connector 1500 via the adapters 1300. The second connector 1500 includes a body with cavities 1510 adapted to receive the interface ends 1332 of the adapters. Each cavity 1510 supports a contact 1502 that mates with the first socket opening 1362 of the adapter's inner contact 1306. Like the first connector 1400, the second connector 1500 preferably engages a printed circuit board such that when the connectors 1400 and 1500 are mated via one or more adapters 1300, an electrical connection is established from one printed circuit board to the other printed circuit board. As seen in FIG. 17, the geometry of the adapter assists with mating, and particularly blind mating, of the connectors 1400 and 1500. In particular, mating is facilitated because the slope of the tapered outer surface 1340 of the adapters' interface end 1332 substantially matches a corresponding interface surface 1512 in the cavities 1510 of the connector 1500.

Figure 18:
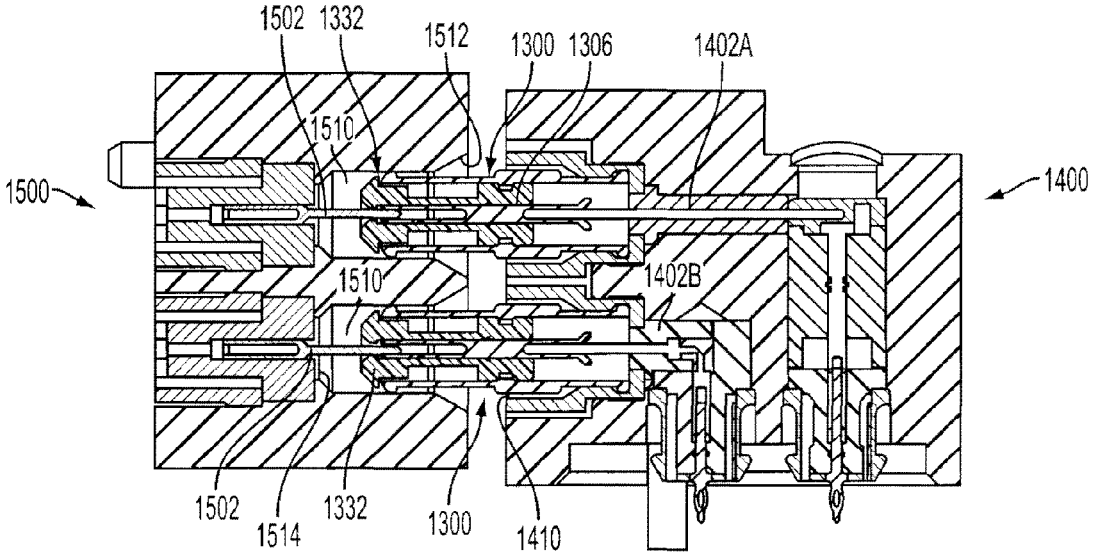
FIG. 18 is a cross-sectional view of an electrical connector assembly similar to FIG. 17, showing the maximum radial and axial float provided by the float adapter.

FIG. 18 illustrates the maximum axial and radial float provided by the adapter 1300. The axial float is provided by the longitudinal length of the adapter 1300. The preferred length of the adapter 1300 is 0.400 inches; however any desired length may be used. At maximum axial float, the interface end 1332 of the adapter 1300 is not fully received in the cavity 1510. That is, the interface end 1332 is spaced from the closed end 1514 of the cavity 1510. The adapter 1300 may move radially in the cavities 1410 and 1510 of the connectors 1400 and 1500, to provide the radial float between the connectors. In particular, the widened area 1416 of the cavity 1410 allows radial movement of the adapter or adapters 1300. In a preferred embodiment, the adapter provides 0.060 inches of axial float and 0.040 inches of radial total (+/−0.020" from centerline).

Figure 19:
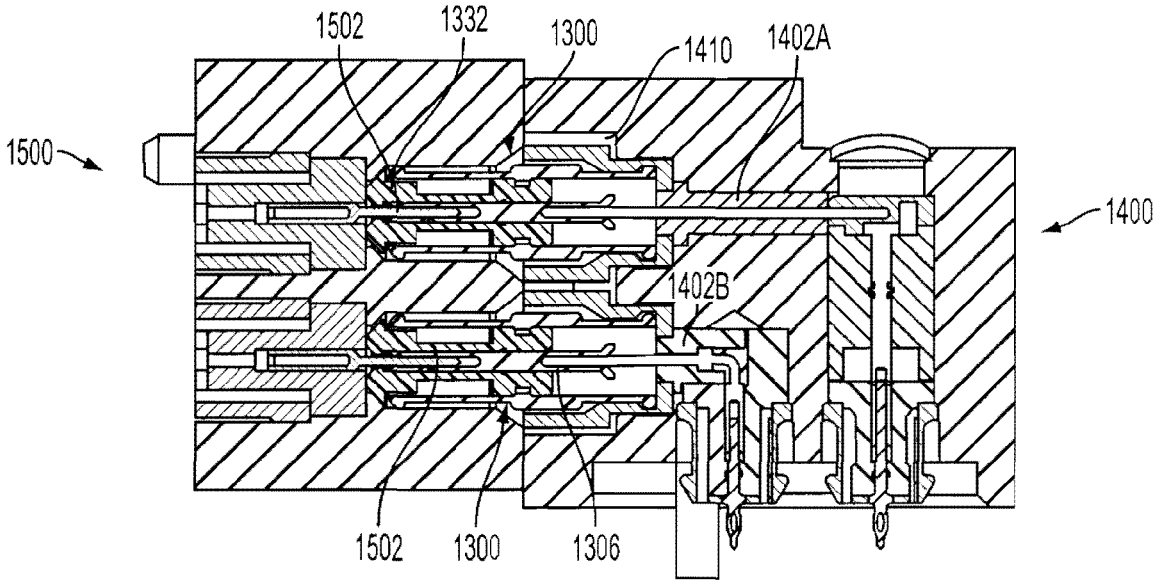
FIG. 19 is a cross-sectional view of the electrical connector assembly illustrated in FIG. 18, showing the electrical connector components mated with the minimum float.

FIG. 19 illustrates the first and second connectors 1400 and 1500 mated with minimum or no float. In this case, the interface end 1332 of the adapter 1300 is fully received within the cavity 1510 of the second connector 1500 such that there is little to no space between the cavity's closed end 1512 and the adapter's interface end 1332.

While particular embodiments have been chosen to illustrate the invention, it will be understood by those skilled in the art that various changes and modifications can be made therein without departing from the scope of the invention as defined in the appended claims. For example, although the connectors may be shown as a right angle connector, the connectors may any type of connector, including a straight connector, and vice versa.

What is claimed is:

1. A float adapter for an electrical connector, comprising:

a conductive shell having opposite first and second ends;

an insulator received in said conductive shell, said insulator including an engagement end, an interface end opposite said engagement end, and a reduced diameter middle portion therebetween, said insulator including an inner bore extending through said engagement end, said interface end, and said reduced diameter middle portion, said interface end having a lead-in tip portion extending outside of said first end of said conductive shell, said lead-in tip portion having a tapered outer surface terminating in an end face surface, and a shoulder remote from said end face surface defining an outer diameter that is larger than the inner diameter of said conductive shell, and said reduced diameter middle portion defining an annular space between said insulator and said conductive shell; and an inner contact received in said inner bore of said insulator, said inner contact having socket openings at either end.

2. A float adapter according to claim 1, wherein each of said first and second ends of said conductive shell includes an annular lip.

3. A float adapter according to claim 2, wherein each of said first and second ends of said conductive shell having slots that define spring fingers.

4. A float adapter according to claim 3, wherein said engagement end of said insulator has an outer diameter than is substantially the same as said inner diameter of said conductive shell.

5. A float adapter according to claim 4, wherein said engagement end of said insulator includes an outer annular groove adapted to engage an inner rib of said conductive shell.

6. A float adapter according to claim 5, wherein said end face surface of said interface end of said insulator includes an interface opening in communication with said inner bore, said interface opening having an inner surface that tapers inwardly toward said inner bore.

7. A float adapter according to claim 6, wherein said interface end of said insulator includes an inner stopping shoulder at said interface opening.

8. An electrical connector assembly, comprising:

a first connector having at least one first pin contact extending into at least one first cavity;

a second connector having at least one second pin contact extennding into at least one second cavity; and at least one float adapter coupling said first and second connectors, said float adapter including:

a conductive shell having opposite first and second ends, said first end having a lip configured to engage a corresponding groove in said first cavity of said first connector, an insulator received in said conductive shell, said insulator including an engagement end, an interface end opposite said engagement end, a. reduced diameter middle portion therebetween, and an inner bore extending through said engagement end, said interface end, and said reduced diameter middle portion, said interface end having a lead-in tip portion extending outside of said first end of said conductive shell, said lead-in tip portion having a tapered outer surface terminating in an end face surface and a shoulder remote from said end face surface defining an outer diameter that is larger than the inner diameter of said conductive shell, and said reduced diameter middle portion defining an annular space between said insulator and said conductive shell, and an inner contact received in said inner bore of said insulator, said inner contact having first and second socket openings at either end thereof for connecting with said first and second pin contacts, respectively;

wherein said at least one float adapter provides axial and radial float between said first and second connectors.

9. An electrical connector assembly according to claim 8, wherein each of said first and second connectors is adapted to connect to a printed circuit board.

10. An electrical connector assembly according to claim 8, wherein said second cavity of said second connector includes an outwardly tapered opening for receiving the interface end of said float adapter.

11. An electrical connector assembly according to claim 8, wherein said first cavity includes an insert for receiving the first end of said conductive shell of said float adapter, said insert includes said groove that engages said lip of said first end.

12. An electrical connector assembly according to claim 8, further comprising a second float adapter coupling said first and second connectors, said second float adapter including, a conductive shell having opposite first and second ends, said first end having a lip configured to engage a corresponding groove in a second cavity of said first connector, an insulator received in said conductive shell, said insulator including an engagement end, an interface end opposite said engagement end, a reduced diameter middle portion therebetween, and an inner bore extending through said engagement end, said interface end, and said reduced diameter middle portion, said interface end having a lead-in tip portion extending outside of said first end of said conductive shell, said lead-in tip portion having a tapered outer surface terminating in an end face surface and a shoulder remote from said end face surface defining an outer diameter that is larger than the inner diameter of said conductive shell, and said reduced diameter middle portion defining an annular space between said insulator and said conductive shell, and an inner contact received in said inner bore of said insulator, said inner contact having first and second socket openings at either end thereof for connecting with a third pin contact of said first connector and a fourth pin contact of said second connector, respectively.

13. Method of assembly of a float adapter, comprising the steps of providing a conductive shell that has first and second ends;

providing an insulator, the insulator has an engagement end, an interface end opposite the engagement member, a reduced diameter middle portion therebetween, and an inner bore extending through the engagement end, the interface end, and the reduced diameter middle portion;

inserting the insulator into the conductive shell through the first end of the conductive shell, wherein the engagement members of the conductive shell and the insulator snap together;

providing an inner contact that has first and second contact at either end thereof; and inserting the inner contact through the second end of the conductive body and into the inner bore of the insulator, wherein the contact is inserted into the internal bore of the insulator until the contact abuts a shoulder of the insulator.

14. A method of claim 13, wherein the interface end having a lead-in tip portion extending outside of the first end of the conductive shell, the lead-in tip portion has a tapered outer surface terminating in an end face surface and a shoulder remote from the end face surface defining an outer diameter that is larger than the inner diameter of the conductive shell.

15. A method of claim 13, wherein the insulator is inserted into the conductive shell until an engagement member of the insulator engages a corresponding engagement member of the conductive shell.

16. A method of claim 13, wherein the reduced diameter middle portion defines an annular space between the insulator and the conductive shell.

* * * * *